US009498990B2

(12) United States Patent
Fukuda

(10) Patent No.: US 9,498,990 B2
(45) Date of Patent: Nov. 22, 2016

(54) LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/541,734

(22) Filed: Nov. 14, 2014

(65) Prior Publication Data

US 2015/0145912 A1 May 28, 2015

(30) Foreign Application Priority Data

Nov. 28, 2013 (JP) ..... 2013-245793

(51) Int. Cl.

| | |
|---|---|
| ***B41J 2/045*** | (2006.01) |
| ***B41J 2/175*** | (2006.01) |
| ***B41J 25/00*** | (2006.01) |
| ***B41J 19/20*** | (2006.01) |

(52) U.S. Cl.

CPC ..... *B41J 19/202* (2013.01); *B41J 2/04503* (2013.01); *B41J 2/04568* (2013.01); *B41J 2/175* (2013.01)

(58) Field of Classification Search

CPC ..... B41J 2/04503

See application file for complete search history.

(56) References Cited

U.S. PATENT DOCUMENTS

| | | | | |
|---|---|---|---|---|
| 5,788,385 | A * | 8/1998 | Inoue et al. | 347/37 |
| 5,873,663 | A * | 2/1999 | Yokoi et al. | 400/279 |
| 6,302,506 | B1 * | 10/2001 | Norton | 347/14 |
| 6,419,338 | B1 * | 7/2002 | Ikeda | 347/14 |
| 2001/0028375 | A1 * | 10/2001 | Ohtani et al. | 347/37 |
| 2010/0231630 | A1 * | 9/2010 | Okazaki | B41J 2/16526 347/14 |
| 2013/0194371 | A1 * | 8/2013 | Kano | 347/190 |
| 2013/0342596 | A1 * | 12/2013 | Izawa et al. | 347/9 |

FOREIGN PATENT DOCUMENTS

JP 2007-237477 9/2007

* cited by examiner

*Primary Examiner* — Shelby Fidler
(74) *Attorney, Agent, or Firm* — Workman Nydegger

(57) ABSTRACT

A printer includes a recording head, a carriage moving mechanism which moves the recording head in a scan direction, and a driving signal generating circuit which generates a driving signal including an ejection pulse for ejecting ink from the nozzle, and while moving the recording head using the carriage moving mechanism, forms an image on the recording medium based on ejection control data, and includes a control unit that in a case where an amount of the pixel data corresponding to a predetermined area on the recording medium is relatively large, performs control in such a manner that the moving speed of the recording head at a constant speed section at which the recording head moves at a constant speed is slower than that in a case where an amount of data is relatively small.

3 Claims, 5 Drawing Sheets

LIQUID EJECTING APPARATUS

CROSS-REFERENCE TO RELATED APPLICATIONS

The present application claims priority to Japanese Patent Application No. 2013-245793 filed on Nov. 28, 2013, which is hereby incorporated by reference in its entirety.

BACKGROUND

1. Technical Field

The present invention relates to a liquid ejecting apparatus that ejects liquid from a nozzle.

2. Related Art

A liquid ejecting apparatus is an apparatus that includes a liquid ejecting head and ejects various liquids from the ejecting head. As such a liquid ejecting apparatus, an image recording apparatus is used, such as an ink jet type printer or an ink jet type plotter, but in recent years, the liquid ejecting apparatus has also been applied to various manufacturing apparatuses by taking advantage of the feature in which a very small amount of liquid can be accurately landed at a predetermined position. For example, the liquid ejecting apparatus is applied to a display manufacturing apparatus that manufactures a color filter such as a liquid crystal display, an electrode forming apparatus that forms an electrode such as an organic electro luminescence (EL) display or an FED (field emission display), or a chip manufacturing apparatus that manufactures a bio-chip (biological and chemical element). Then, liquid ink in a recording head of an image recording apparatus is ejected, and solution with color material such as red (R), green (G), or blue (B) in a color material ejecting head of a display manufacturing apparatus is ejected. In addition, liquid electrode material in an electrode material ejecting head for an electrode forming apparatus is ejected, and a solution of bio-organic material in a bio-organic material ejecting head of a chip manufacturing apparatus is ejected.

A liquid ejecting head such as that described above is configured in such a manner that ink is introduced into a pressure chamber from a liquid storage source such as an ink tank in which ink (a type of liquid) is stored, pressure variation is generated in the ink stored in the pressure chamber, and ink droplets are ejected from a nozzle leading to the pressure chamber. In recent years, in order to improve printing efficiency, the trend has been for an ejection interval between ink droplets which are ejected from a nozzle to be shortened as much as possible. For this reason, for example, there is a possibility that an amount of supply of ink to a pressure chamber may be insufficient, if ink droplets are ejected from a nozzle based on print data in such a manner that a high definition image can be printed (recorded) on a recording medium (a type of landing target). If an amount of supply of ink to a pressure chamber is insufficient, a negative pressure (hereinafter, referred to as back pressure) in a pressure chamber increases, and a change of ejection characteristics occurs, such as an amount of ink droplets which are ejected decreasing. In addition, in some cases, there is a possibility that ink droplets may not be ejected from a nozzle. As a result, irregularity may occur in an image being printed or dot omission may occur. In order to suppress irregularity of an image or the like due to such a change of a back pressure, back pressure variation being predicted based on an amount of ejection of ink droplets which are calculated from print data, and an amount of ejection of ink droplets being controlled by correcting print data based on the prediction have been developed, thereby suppressing irregularity of an image (for example, JP-A-2007-237477).

However, in a so-called serial printer which performs recording on a recording medium by scanning a liquid ejecting head in a predetermined direction, printing (ejection of ink droplets) is performed not only at a constant speed section at which the liquid ejecting head moves at a constant speed, but also at an acceleration and deceleration section at which the liquid ejecting head is accelerated or decelerated. Since the liquid ejecting head at the acceleration and deceleration section has a slower moving speed than that at a constant speed section, an ejection interval of ink droplets which are ejected from a nozzle is lengthened relatively. For this reason, at the acceleration and deceleration section, it is easy to relatively stabilize supplying of ink to a pressure chamber. However, in JP-A-2007-237477, since a moving speed of a liquid ejecting head, in other words, ejection control of ink droplets in which an ejection interval (usage status of nozzle) of ink droplets is taken into account is not performed, there is a possibility that the ejection of ink droplets may be suppressed, even if ink is sufficiently supplied to a pressure chamber at the acceleration and deceleration section. As a result, there is a possibility that ejection efficiency (printing efficiency) of ink may decrease.

SUMMARY

An advantage of some aspects of the invention is that a liquid ejecting apparatus is provided in which irregularity of an image which is printed can be suppressed and liquid can be efficiently ejected.

According to a first aspect of the invention, a liquid ejecting apparatus includes a liquid ejecting head that includes a pressure generating unit for generating pressure variation of liquid stored in a pressure chamber communicating with a nozzle and which ejects the liquid towards a landing target from the nozzle according to driving of the pressure generating unit, a head moving unit which moves the liquid ejecting head in a scan direction, and a driving signal generating unit which generates a driving signal including an ejection pulse for ejecting the liquid from the nozzle. While moving the liquid ejecting head by the head moving unit, the liquid ejecting apparatus forms an image on the landing target based on ejection control data. The liquid ejecting apparatus includes a control unit that in a case where an amount of the ejection control data corresponding to a predetermined area on the landing target is relatively large, performs control in such a manner that the moving speed of the liquid ejecting head at a constant speed section at which the liquid ejecting head moves at a constant speed is slower than that in a case where an amount of the ejection control data is relatively small.

According to a second aspect of the invention, a liquid ejecting apparatus includes a liquid ejecting head that includes a pressure generating unit for generating pressure variation of liquid stored in a pressure chamber communicating with a nozzle and which ejects the liquid towards a landing target from the nozzle according to driving of the pressure generating unit, a head moving unit which moves the liquid ejecting head in a scan direction, and a driving signal generating unit which generates a driving signal including an ejection pulse for ejecting the liquid from the nozzle. While moving the liquid ejecting head by the head moving unit, the liquid ejecting apparatus forms an image on the landing target based on ejection control data. The liquid ejecting apparatus includes a control unit that in a case where an amount of the ejection control data corresponding to a predetermined area on the landing target is relatively large, performs control in such a manner that an acceleration and deceleration section at which the liquid ejecting head is accelerated or decelerated is shortened, and performs control in such a manner that the moving speed of the liquid ejecting head at a constant speed section at which the liquid ejecting head moves at a constant speed is slower than that in a case where an amount of the ejection control data is relatively small.

According to such configurations, if an amount of data is relatively large, the moving speed (acceleration) of the liquid ejecting head is not suppressed at the acceleration and deceleration section, and the moving speed of the liquid ejecting head can be suppressed at the constant speed section. As a result, at the constant speed section in which the moving speed of the liquid ejecting head is the fastest, it is possible to relatively lengthen the ejection interval of the ink droplets which are ejected from the nozzle, and to stabilize the supply of the ink to the pressure chamber. As a result, it is possible to suppress irregularity of an image or the like occurring due to an increase of the back pressure (negative pressure) of the pressure chamber. In addition, since the moving speed (acceleration) of the liquid ejection head at the acceleration and deceleration section may not be suppressed, the ejection of the ink droplets can be prevented from being excessively suppressed at the acceleration and deceleration section. As a result, it is possible to increase ejection efficiency (printing efficiency) of ink. In addition, "ejection control data" is dot pattern data or pixel data which is obtained by developing for each dot printing data which is input from an external apparatus such as a host computer, and data which is input to the liquid ejecting head.

According to a third aspect of the invention, a liquid ejecting apparatus includes a liquid ejecting head that includes a pressure generating unit for generating pressure variation of liquid stored in a pressure chamber communicating with a nozzle and which ejects the liquid towards a landing target from the nozzle according to driving of the pressure generating unit, a head moving unit which moves the liquid ejecting head in a scan direction, and a driving signal generating unit which generates a driving signal including an ejection pulse for ejecting the liquid from the nozzle. While moving the liquid ejecting head by the head moving unit, the liquid ejecting apparatus forms an image on the landing target based on ejection control data. The liquid ejecting apparatus includes a control unit that in a case where an amount of the ejection control data corresponding to a predetermined area on the landing target is relatively large, performs control in such a manner that the number of pulses included at the predetermined area is larger than that in a case where an amount of the ejection control data is relatively small.

According to such a configuration, if an amount of data per a predetermined area is relatively large, the number of passes included in the predetermined area is divided, and thereby it is possible to reduce an amount of ink which is ejected from a nozzle per unit time. As a result, it is possible to stabilize supplying of ink to a pressure chamber. As a result, it is possible to suppress irregularity of an image or the like occurring due to an increase of the back pressure (negative pressure) of the pressure chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
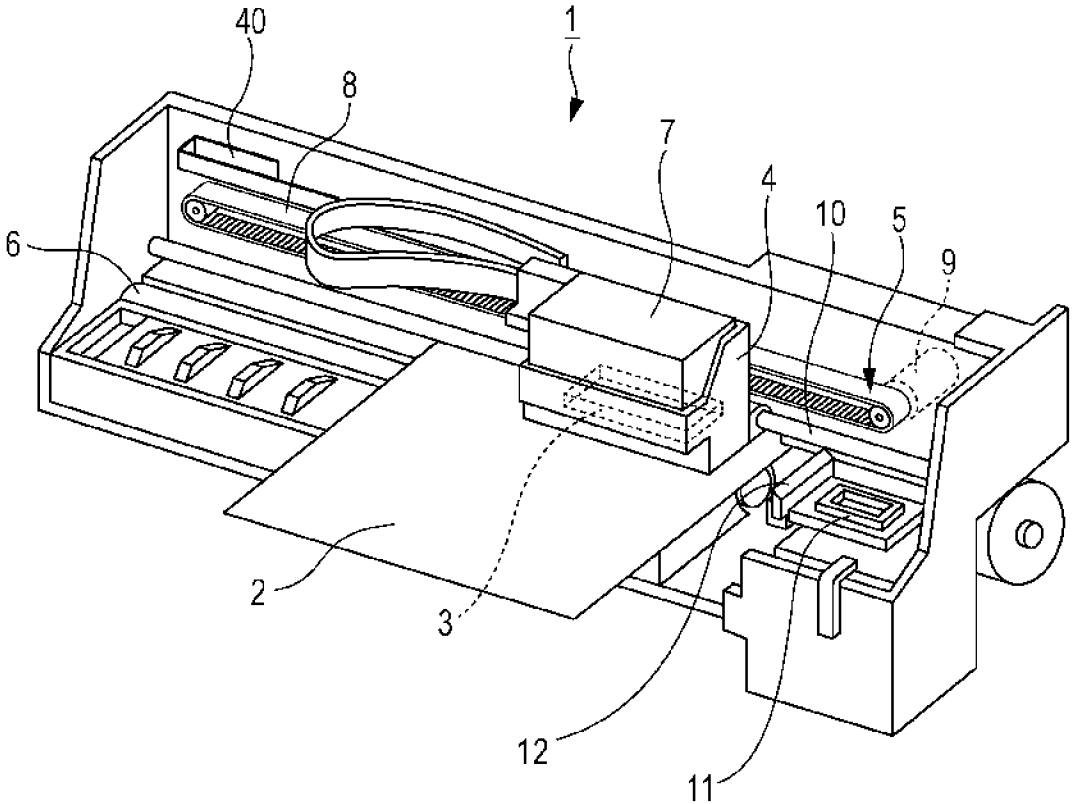
FIG. 1 is a perspective view illustrating a configuration of a printer.

Hereinafter, a form for performing the invention will be described with reference to the attached drawings. In addition, in the embodiments which will be described below, various limits will be made to the preferred embodiments of the invention, but a scope of the invention is not limited to such embodiments, as long as there is no description to the effect that the invention is particularly limited in the following description. In addition, in the following description, as a liquid ejecting apparatus according to the invention, an ink jet type printer (hereinafter, referred to as printer) is exemplified, in which an ink jet type recording head (hereinafter, referred to as recording head), a type of a liquid ejecting head, is mounted.

A configuration of a printer 1 will be described with reference to FIG. 1. The printer 1 is an apparatus which records an image or the like by ejecting ink of liquid state onto a surface of a recording medium 2 (a type of landing target) of recording paper or the like. The printer 1 includes a recording head 3, a carriage 4 to which the recording head 3 is attached, a carriage moving mechanism 5 (corresponds to a head moving unit according to the invention) which moves the carriage 4 in a main scanning direction, and a transporting mechanism 6 which transports the recording medium 2 in a sub-scanning direction. Here, the ink is a type of liquid of the invention, and is stored in an ink cartridge 7 as a liquid supply source. The ink cartridge 7 is mounted detachably with respect to the recording head 3. In addition, it is possible to employ a configuration in which the ink cartridge is arranged on a main body side of the printer, and the ink is supplied from the ink cartridge to the recording head via an ink supply tube.

The carriage moving mechanism 5 includes a timing belt 8. Furthermore, the timing belt 8 is driven by a pulse motor 9 such as a DC motor. Thus, if the pulse motor 9 operates, the carriage 4 is guided on a guide rod 10 installed in the printer 1, and performs a reciprocating motion in the main scanning direction (width direction of recording medium 2). A position in the main scanning direction of the carriage 4 is detected by a linear encoder 40 which is a type of a position information detection unit. The linear encoder 40 transmits the detection signal, that is, an encoder pulse (a type of position information) to a control unit 41 of the printer 1.

In addition, outside of a recording area within a moving range of the carriage 4, a home position which is a base point of scanning of the carriage 4 is set in an end area of one side (right hand side of FIG. 1). In the home position, a cap 11 which seals a nozzle surface (nozzle plate 21) of the recording head 3, a wiper 12 for wiping the nozzle surface, and the like are arranged. Then, the printer 1 performs so-called bi-directional recording which records characters, an image, or the like on the recording medium 2, in both directions at the time of forward moving in which the carriage 4 moves from the home position toward an end portion of an opposite side thereto, and at the time of backward moving in which the carriage 4 returns from the end portion of the opposite side to the home position side.

Figure 2:
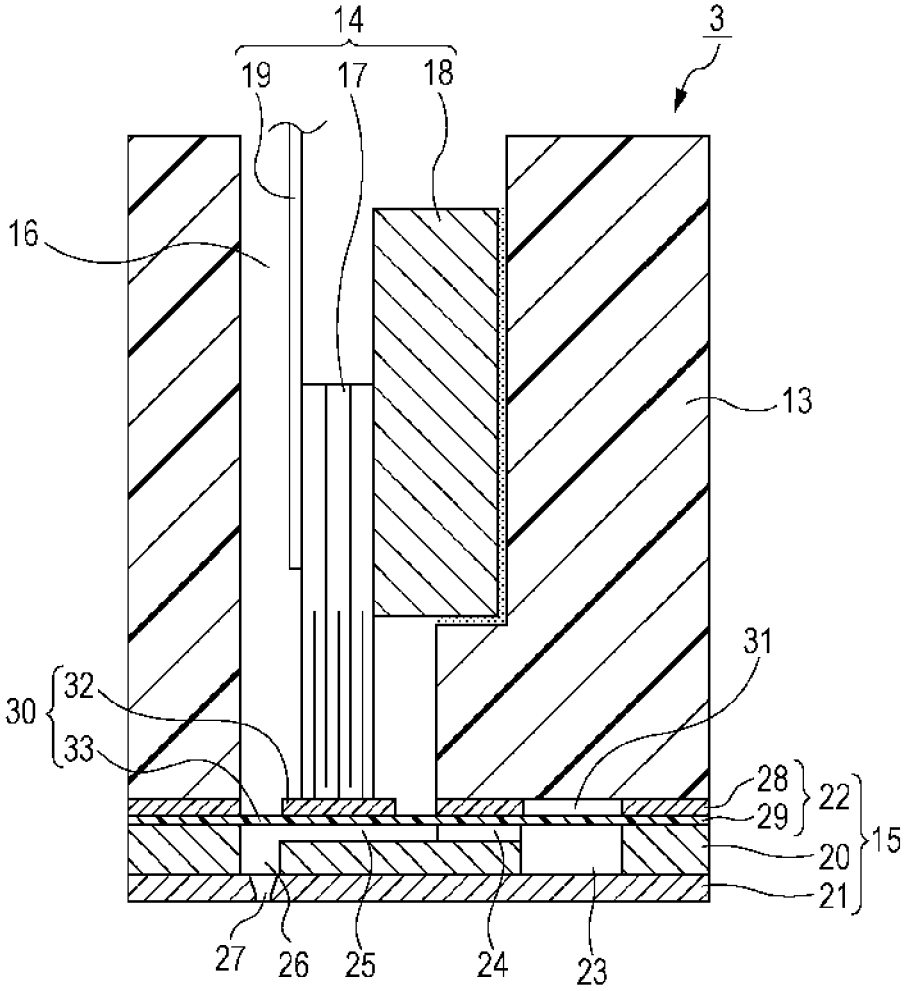
FIG. 2 is a cross-sectional view of a recording head.

FIG. 2 is a schematic cross-sectional view illustrating a configuration of the recording head 3. The recording head 3 is configured to include a case 13, a vibrator unit 14 contained in the case 13, a flow path unit 15 which is bonded to a bottom surface (tip surface) of the case 13, and the like. The case 13 is made of, for example, an epoxy resin, and a containing portion 16 for containing the vibrator unit 14 is formed inside the case 13. The vibrator unit 14 includes a piezoelectric element 17 which functions as a type of a pressure generating unit, a fixing plate 18 to which the piezoelectric element 17 is bonded, and a flexible cable 19 for supplying a driving signal to the piezoelectric element 17. The piezoelectric element 17 is a stack type which is made by dividing into a comb shape a piezoelectric plate in which a piezoelectric body layer and an electrode layer are alternately stacked, and is a piezoelectric element of a longitudinal vibration mode, which can expand and contract in a direction orthogonal to a stack direction.

The flow path unit 15 is configured by bonding the nozzle plate 21 to a surface of one side of a flow path forming substrate 20, and an elastic plate 22 to a surface of the other side of the flow path forming substrate 20, respectively. In the flow path unit 15, a reservoir 23, an ink supplying hole 24, a pressure chamber 25, a nozzle communication hole 26, and a nozzle 27 are provided. The reservoir 23 is an empty portion which extends along the nozzle row for each nozzle row, and communicates with an ink introduction path (not illustrated) provided in the case 13. In addition, on a side of the reservoir 23, a plurality of ink supplying holes 24 open in correspondence to each nozzle 27 which configures the nozzle row. Then, a series of ink flow paths are formed for each nozzle 27, which connect the ink supplying hole 24 to the nozzle via the pressure chamber 25 and the nozzle communication hole 26. As a result, the ink which is introduced into the reservoir 23 from the ink cartridge 7 via the ink introduction path is supplied to each pressure chamber 25 via the ink supplying hole 24.

The nozzle plate 21 is a thin plate which is configured of stainless steel (SUS), silicon single crystal or the like, and the number of rows of the nozzles 27 (nozzle rows) which are provided is two or more. The elastic plate 22 has a dual structure which is formed by stacking an elastic body film 29 formed by a resin film or the like on a surface of a support plate 28 formed of a metal or the like. In the elastic plate 22, a diaphragm unit 30 which changes a volume of the pressure chamber 25 is provided. The diaphragm unit 30 is formed by an island unit 32 to which a tip surface of the piezoelectric element 17 is bonded, and a thin elastic unit 33 which surrounds the island unit 32. In addition, in the elastic plate 22, a compliance unit 31 which seals a portion of the reservoir 23 is provided. The compliance unit 31 functions as a damper which absorbs pressure variation of the ink stored in the reservoir 23.

Then, since a tip surface of the piezoelectric element 17 is bonded to the island unit 32, it is possible to make the volume of the pressure chamber 25 vary by expanding and contracting a free end of the piezoelectric element 17. Due to the volume variation, pressure variation occurs in the ink in the pressure chamber 25. Then, the recording head 3 ejects the ink droplets from the nozzle 27 using the pressure variation.

Figure 3:
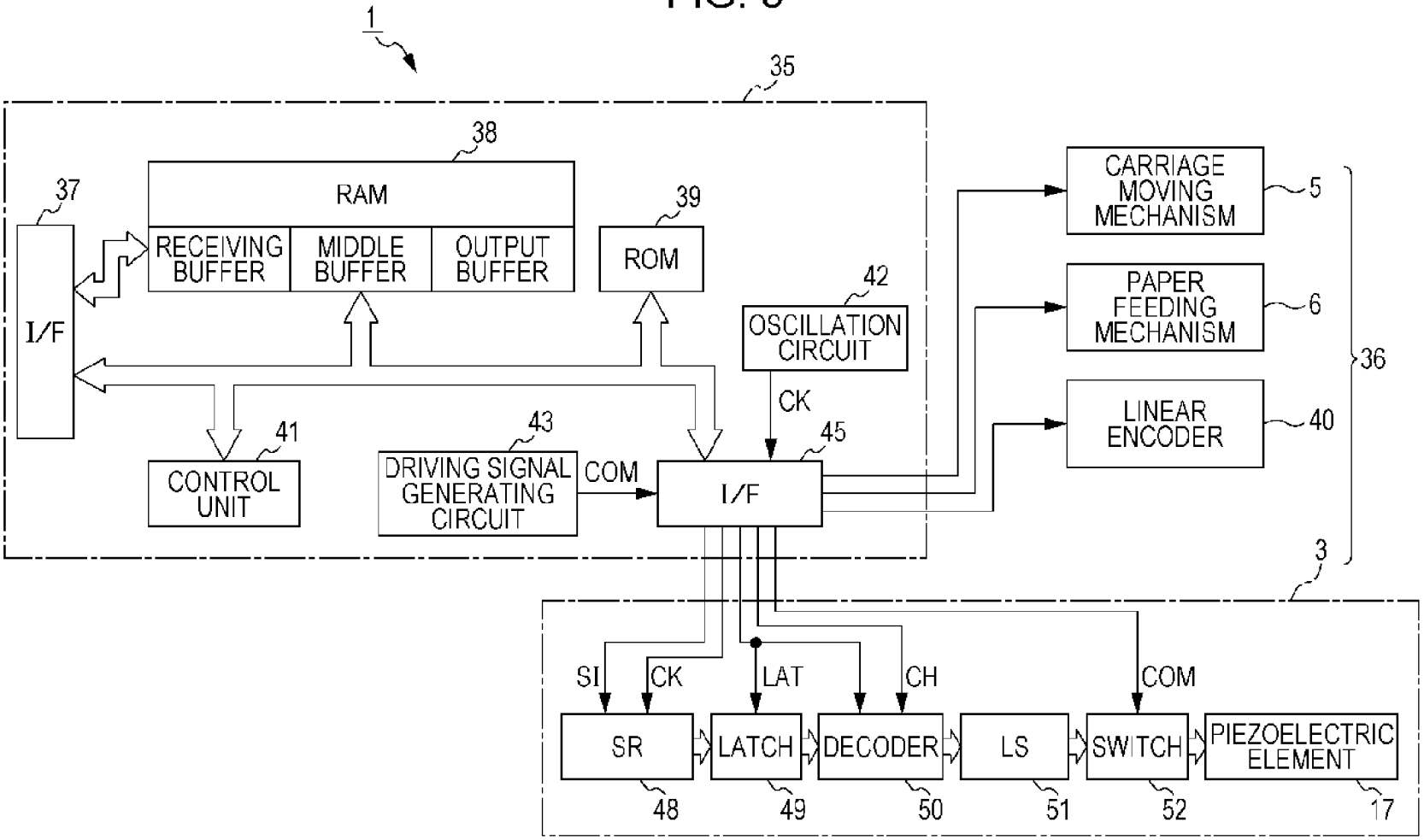
FIG. 3 is a block diagram illustrating an electrical configuration of a printer.

FIG. 3 is a block diagram illustrating an electrical configuration of the printer 1. The printer 1 is schematically configured with a printer controller 35 and a printer engine 36. The printer controller 35 includes an external interface (external I/F) 37 to which printing data or the like is input from an external apparatus such as a host computer, a RAM 38 which stores various data or the like, a ROM 39 which stores a control routine or the like for processing of various data, a control unit 41 which performs control of each unit, an oscillation circuit 42 which generates a clock signal, a driving signal generating circuit 43 (corresponds to a driving signal generating unit of the invention) that generates a driving signal which is supplied to the recording head 3, and an internal interface (internal I/F) 45 for outputting pixel data SI which is obtained by developing the printing data for each dot, the driving signal or the like to the recording head 3.

The control unit 41 outputs a head control signal for controlling the operation of the recording head 3 to the recording head 3, or outputs a control signal for generating a driving signal COM to the driving signal generating circuit 43. The head control signal is, for example, a transmission clock CLK, pixel data SI, a latch signal LAT, or a change signal CH. The latch signal or the change signal specifies a supply timing of each pulse which configures the driving signal COM. In addition, based on the printing data, the control unit 41 generates the pixel data SI which is used in ejection control of the recording head 3, through color conversion processing of converting an RGB color system into a CMY color system, halftone processing of reducing data with multi-tones to a predetermined tone, dot pattern development processing of developing half-toned data in parallel to dot patterning data with a predetermined arrangement for each ink type (for each nozzle row), or the like. The pixel data SI is data relating to a pixel of an image to be printed, and is a type of ejection control data. Here, the pixel indicates a dot forming area which is virtually defined on a recording medium such as recording paper which is a landing target material.

In addition, the control unit 41 functions as a timing pulse generating unit which generates a timing pulse PTS (refer to FIG. 5), based on an encoder pulse EP which is output from the linear encoder 40. The timing pulse PTS is a signal that determines a generation start timing of a driving signal COM which is generated by the driving signal generating circuit 43. That is, the driving signal generating circuit 43 outputs a driving signal COM each time the timing pulse PTS is received. Furthermore, if an amount of data of the pixel data SI corresponding to (for example, per unit scan) a predetermined area (recording-scheduled area) of the recording medium 2 is relatively large, the control unit 41 according to the invention functions as a controller that controls in such a manner that a moving speed of the recording head 3 at a constant speed section at which the recording head 3 moves at a constant speed is slower than that in a case where an amount of data is relatively small. In addition, control of the moving speed of the recording head 3 will be described later.

The driving signal generating circuit 43 is controlled by the control unit 41, and as described above, generates the driving signal COM or various driving signals based on the timing pulse PTS. The driving signal COM is an analog voltage signal that is applied to the piezoelectric element 17 of the recording head 3 at the time of a recording operation, and is a series of signals having a plurality of pulse waveforms within a unit recording period (liquid ejection period). For example, the driving signal COM includes in a series an ejection pulse corresponding to a large dot, an ejection pulse corresponding to a middle dot, and an ejection pulse corresponding to a small dot.

Figure 4:
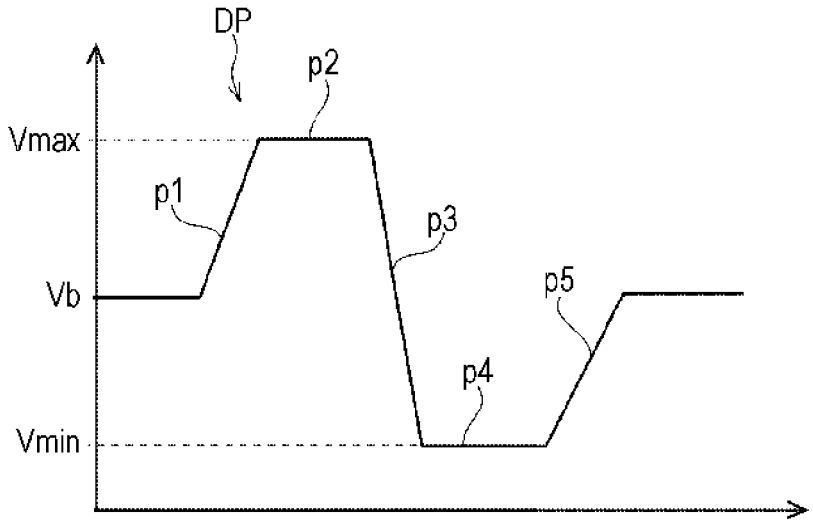
FIG. 4 is a waveform diagram illustrating a configuration of an ejection pulse.

FIG. 4 is a waveform diagram illustrating an example of an ejection pulse. In addition, a vertical axis of FIG. 4 denotes voltage, and a horizontal axis denotes time. An ejection pulse DP illustrated in FIG. 4 includes an expansion element p1, an expansion maintaining element p2, a contraction element p3, a contraction maintaining element p4, and a returning element p5. The expansion element p1 is a waveform element that expands the pressure chamber 25 by changing a potential toward a positive side from a reference potential (middle potential) Vb to a maximum potential (maximum voltage) Vmax. The expansion maintaining element p2 is a waveform element that maintains the maximum potential Vmax for a constant time. The contraction element p3 is a waveform element that rapidly contracts the pressure chamber 25 by changing a potential toward a negative side from a maximum potential Vmax to a minimum potential (minimum voltage) Vmin. The contraction maintaining element p4 is a waveform element that maintains the minimum potential Vmin for a constant time. The returning element p5 is a waveform element that returns a potential from the minimum potential Vmin to the reference potential Vb.

If the ejection pulse DP configured in this way is supplied to the piezoelectric element 17, the piezoelectric element 17 is first contracted by the expansion element p1, thereby displacing the island unit 32 of the diaphragm unit 30 so as to be separated from the pressure chamber 25, and as a result, the pressure chamber 25 is expanded from a normal volume corresponding to the reference potential Vb to an expanded volume corresponding to the maximum potential Vmax. By the expansion, a meniscus is largely drawn to the pressure chamber 25 side, and the ink is supplied to the pressure chamber 25 from the reservoir 23 side via the ink supply hole 24. Then, an expansion state of the pressure chamber 25 is maintained over a period in which the expansion maintaining element p2 is generated. Thereafter, the contraction element p3 is applied and thereby the piezoelectric element 17 expands and the island unit 32 is displaced toward the pressure chamber 25. As a result, the pressure chamber 25 rapidly contracts from the expanded volume to the contracted volume corresponding to the minimum potential Vmin. The ink stored in the pressure chamber 25 is pressurized by the rapid contraction of the pressure chamber 25, and thereby a specified amount (for example, several nanograms to several tens of nanograms) of ink is ejected from the nozzle 27. A contraction state of the pressure chamber 25 is maintained over a period in which the contraction maintaining element p4 is supplied, and by supplying of the returning element p5 after that, the pressure chamber 25 expands to the normal volume to return thereto. In addition, the ejection pulse is not limited to the exemplified waveform, and can be used as an ejection pulse which ejects the ink corresponding to each dot size, using waveforms configured in various ways.

Figure 5:
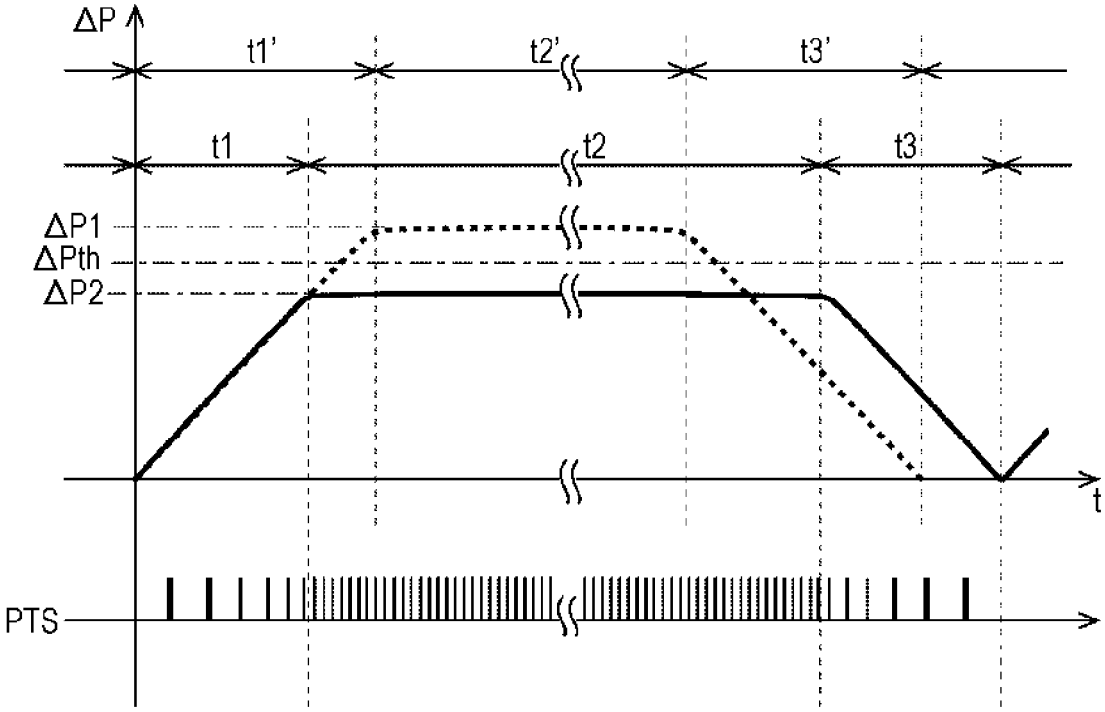
FIG. 5 is a diagram illustrating an ejection limit of ink according to a first embodiment.

Thus, the printer 1 according to the present embodiment is configured in such a manner that the ink is ejected from the recording head 3 not only at a constant speed section at which the carriage 4 (recording head 3) moves at constant speed, but also during acceleration moving or deceleration moving (acceleration and deceleration section) of the carriage 4, and thereby it is possible to record an image or text based on the image data SI on the recording area (liquid ejection area) of the recording medium 2. As a result, it is possible to increase a printing speed and to reduce a head scanning range compared with a configuration in which a direction is changed outside of the recording area (that is, acceleration and deceleration is performed), thereby contributing to miniaturization of the apparatus. In addition, in the acceleration and deceleration section, the moving speed of the carriage 4 is slower than the moving speed at a constant speed section, and thereby, as illustrated in FIG. 5, a generation interval of the timing pulse PTS based on that is longer. For this reason, a generation period (recording period) of the driving signal COM also is longer.

Next, a configuration of the printer engine 36 will be described. The printer engine 36 is configured with the recording head 3, the carriage moving mechanism 5, the paper feeding mechanism 6, and the linear encoder 40. The recording head 3 includes a plurality of shift registers (SR's) 48, a plurality of latches 49, a plurality of decoders 50, a plurality of level shifters (LS's) 51, a plurality of switches 52, and a plurality of piezoelectric elements 17, corresponding to each nozzle 27. The pixel data SI from the printer controller 35 is synchronized with the clock signal CK from the oscillation circuit 42, and is transmitted serially to the shift register 48.

The shift register 48 is electrically connected to the latch 49, and if a latch signal LAT from the printer controller 35 is input to the latch 49, the latch 49 latches the pixel data SI of the shift register 48. The pixel data SI latched in the latch 49 is input to the decoder 50. The decoder 50 translates the pixel data SI of two bits and generates pulse selection data. In addition, the decoder 50 outputs the pulse selection data to the level shifter 51, according to the latch signal LAT or a channel signal CH which is received. In this case, the pulse selection data is input to the level shifter 51 in sequence from the upper bit. The level shifter 51 functions as a voltage amplifier, and outputs an electric signal that is boosted to a voltage which can drive the switch 52. The pulse selection data which is boosted by the level shifter 51 is supplied to the switch 52. The driving signal COM from the driving signal generating circuit 43 is supplied to an input side of the switch 52, and the piezoelectric element 17 is connected to an output side of the switch 52. Then, the pulse selection data controls an operation of the switch 52, that is, supplying of an ejection pulse DP of the driving signals COM to the piezoelectric element 17. By such a switch control, it is possible to selectively apply a portion of the driving signals COM to the piezoelectric element 17.

Here, if an amount of the printing data from an external apparatus is large, that is, if an amount of the pixel data SI which is generated based on the printing data is large (particularly, if an amount of data indicating ink ejection is large as in the case where a predetermined area of the recording medium 2 is filled with ink), ink is ejected with higher frequency, and accordingly a lot of ink is consumed. As a result, an amount of ink which is supplied from the reservoir 23 to the pressure chamber 25 is insufficient, and thereby there is a possibility that the back pressure (negative pressure) of the pressure chamber 25 may increase. If the back pressure of the pressure chamber 25 increases, there is a possibility that image irregularity or dot omission may occur, and thus, in the related art, according to an amount of the pixel data SI, an amount of ink which is ejected from the nozzle 27 per unit time was limited. However, since the moving speed of the carriage 4 at an acceleration and deceleration section is slower than the moving speed at a constant speed section, and an ejection interval of ink droplets is relatively long, the ejection of the ink droplets is suppressed, in spite of a relative stability of an amount of ink which is supplied to the pressure chamber 25. In contrast to this, the invention limits the ejection of the ink droplets by taking the moving speed of the carriage 4 into account, and thus it is possible to efficiently eject the ink droplets. The ejection limit of the ink droplets will be described hereinafter.

FIG. 5 is a timing chart illustrating in association with a change of ΔP, generation timing of the timing pulse PTS. Here, ΔP is a value indicating an amount of ink which is ejected from the recording head 2, that is, a magnitude of the back pressure, and is represented by the following Formula (1).

$$\Delta P = R \times (Iw \times F \times N) \quad (1)$$

In addition, R is a resistance value of the ink, which is determined by composition and operating temperature of the ink, in other words, an integer which is determined by a physical property of the ink which is ejected. Iw is ink weight which is ejected by one time of driving performed by one nozzle 27, F is a frequency (that is, proportional to the moving speed of the carriage 4 (recording head 3)) of the driving signal, and N is the number of the nozzles 27 which is driven (ink droplets are ejected) within a unit recording period.

If a back pressure increases, the value of ΔP increases, and if the back pressure decreases, the value of ΔP decreases. Thus, in the embodiment, the ejection of ink is limited based on ΔP. Specifically, a threshold of ΔP is set in advance, in which supplying of ink to the pressure chamber 25 is insufficient and irregularity of an image, dot omission or the like occurs, and the threshold is stored in the RAM 38, ROM 39 or the like. Then, for example, the control unit 41 calculates ΔP based on Formula (1) described above for each unit scan, and controls the ejection of ink so as not to exceed the stored threshold of ΔP. That is, in a case where an amount of the pixel data SI per unit scan is relatively large, compared to a case where an amount of data is relatively small, ΔP is adjusted so as not to increase by decreasing at least one of the ink weight Iw, the driving signal frequency F, and the number N of the driving nozzles 27.

Here, the dashed line of FIG. 5 is a graph illustrating an example of a change of ΔP in a case where the ejection of ink is not limited, and the solid line of FIG. 5 is a graph illustrating an example of a change of ΔP in a case where the ejection of ink is limited. In a case where the ejection of ink is not limited, as illustrated in FIG. 5 as the dashed line, at the acceleration section t1' in which the carriage 4 is accelerated and at the acceleration section t3' in which the carriage 4 is decelerated, the moving speed of the carriage 4 is slower than that at the constant speed section t2', that is, the value of F lower, and thus the value of ΔP becomes a value which rarely exceeds a threshold ΔPth. Meanwhile, at the constant speed section t2', the value of ΔP becomes ΔP1 higher than the threshold ΔPth. For this reason, there is a possibility that supplying of ink to the pressure chamber 25 may be insufficient at the constant speed section t2', and irregularity of an image, dot omission or the like may occur. Then, the control unit 41 controls in such a manner that ΔP at the constant speed section t2' does not exceed the threshold ΔPth. Specifically, as illustrated in FIG. 5 as the solid line, without changing acceleration of the carriage 4, the time between the acceleration section and the deceleration section is decreased as in times t1 and t3. By doing so, the moving speed of the carriage 4 at the constant speed section t2 becomes slower, that is, the value of F is lower, and the value of ΔP becomes ΔP2 smaller than the threshold ΔPth. As a result, it is possible to stabilize supplying of ink to the pressure chamber 25, and to suppress irregularity of an image or the like which occurs due to an increase of the back pressure (negative pressure) of the pressure chamber 25. In addition, since an amount of change of ΔP per unit time at the acceleration and deceleration sections t1 and t3 is not suppressed, it is possible to prevent the ejection of ink droplets at the acceleration and deceleration sections t1 and t3 from being excessively suppressed. As a result, it is possible to increase the ejection efficiency (printing efficiency) of the ink. In addition, ΔP of FIG. 5 changes in a linear shape at each section t1 to t3, but actually, there is a case of complicatedly changing depending on an amount of the pixel data SI.

However, in the above-described embodiments, the moving speed of the carriage 4, that is, the driving signal frequency F is changed, and thereby the value of ΔP is controlled, but while not being limited to this, the value of ΔP may be controlled by changing at least one of the ink weight Iw, the driving signal frequency F, and the number N of the driving nozzles 27. For example, without changing the moving speed of the carriage 4, the number of passes corresponding to a predetermined area on the recording medium 2, that is, the number N of the driving nozzles 27 may be changed, and thereby the value of ΔP may be controlled. Specifically, in a scan area having a width of a unit pixel in a sub-scan direction, it is possible to set in such a manner that in a case where an amount of data included in the scan area is relatively small, recording can be performed by one scan (one pass) with respect to the scan area, and in a case where an amount of the data is relatively large, recording can be performed by two scans (two passes) with respect to the scan area.

In addition, in the above-described embodiment, the value of ΔP is calculated, and by controlling this value, an amount of ink ejection per unit time is controlled, but the invention is not limited thereto. For example, in a second embodiment illustrated in FIG. 6, and a third embodiment illustrated in FIG. 7, an amount of ink ejection per unit time is controlled by the moving speed of the carriage 4. Specifically, a relationship between an amount of pixel data SI per unit scan and the threshold of the moving speed of the carriage 4 in which irregularity of an image, dot omission or the like occurs due to insufficient supplying of ink to the pressure chamber 25, is stored in advance in the RAM 38, the ROM 39 or the like, for example as a table. Then, the threshold of the moving speed of the carriage 4 corresponding to an amount of the pixel data SI is read from the table for each unit scan. Then, the control unit 41 controls the moving speed of the carriage 4 so as not to exceed the threshold of the read moving speed.

Figure 6:
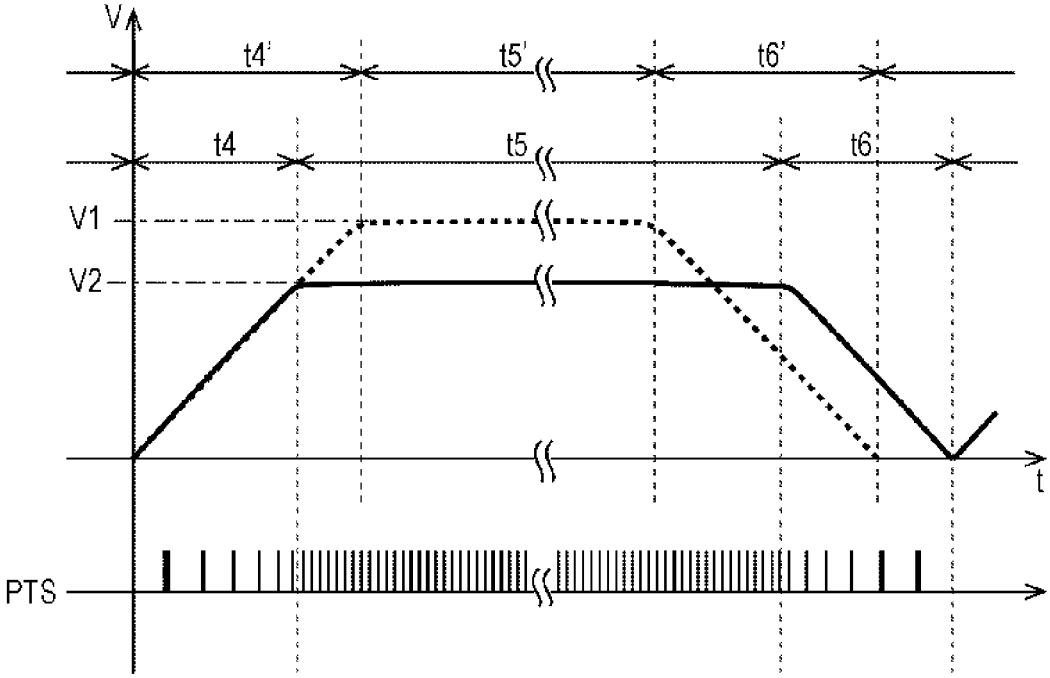
FIG. 6 is a diagram illustrating an ejection limit of ink according to a second embodiment.

For example, as illustrated in FIG. 6 as a dashed line, in a case where an amount of the pixel data SI is relatively small, a maximum moving speed V1 (threshold) of the carriage 4 which is allowed from an amount of the data is derived. Then, the moving speed V1 of the carriage 4 at the constant speed section t5' is set so as not to exceed the maximum moving speed V1, and according to this, lengths of the acceleration and deceleration sections t4' and t6' are set. Meanwhile, as illustrated in FIG. 6 as a solid line, in a case where an amount of the pixel data SI is relatively large, the maximum moving speed of the carriage 4 which is allowed from an amount of the data becomes V2 slower than that in a case where an amount of the data is relatively small. For this reason, the moving speed of the carriage 4 at the constant speed section t5 is set to V2, and according to this, the lengths of the acceleration and deceleration sections t4 and t6 are set. In the present embodiment, without changing the acceleration of the carriage 4, times of the acceleration section and the deceleration section are shortened, and thus, the moving speed of the carriage 4 at the constant speed section is set. By doing so, it is possible to stabilize supplying of ink to the pressure chamber 25, and to suppress irregularity of an image or the like which occurs due to an increase of the back pressure (negative pressure) of the pressure chamber 25. In addition, since the acceleration of the carriage 4 at the acceleration and deceleration sections t4 and t6 is not suppressed, it is possible to prevent the ejection of ink droplets at the acceleration and deceleration sections t4 and t6 from being excessively suppressed. As a result, it is possible to increase the ejection efficiency (printing efficiency) of the ink.

Figure 7:
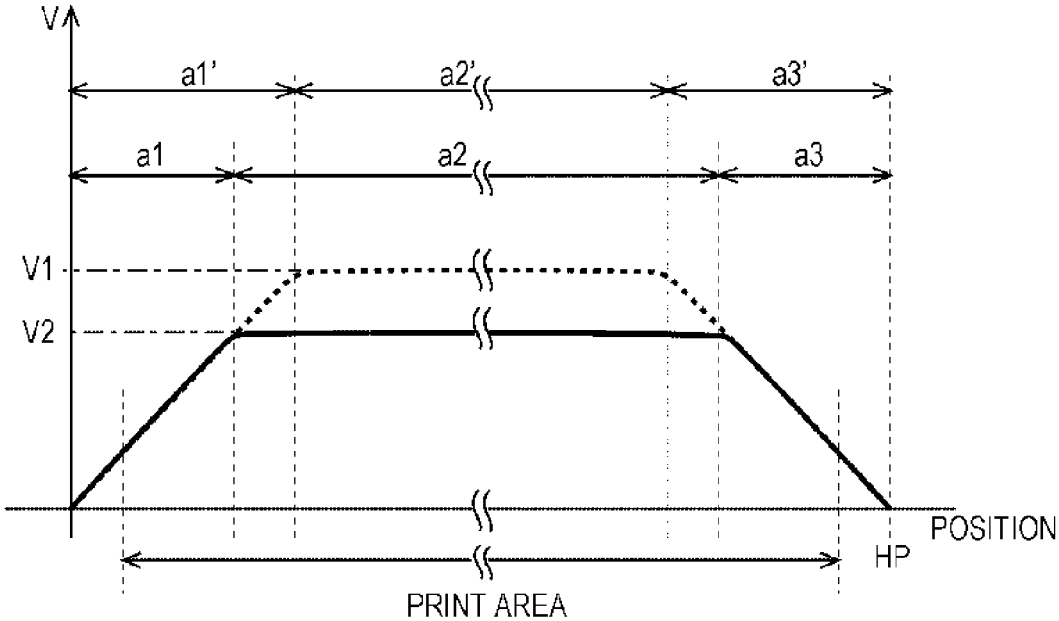
FIG. 7 is a diagram illustrating an ejection limit of ink according to a third embodiment.

In addition, in the third embodiment illustrated in FIG. 7, the moving speed V of the carriage 4 is changed depending on the area in the main scan direction, and thus, an amount of ink ejection per unit time is suppressed. In addition, a horizontal axis illustrated in FIG. 7 denotes a position of the carriage 4, an end portion of the right hand side corresponds to a home position HP, and an end portion of the left hand side corresponds to an end portion of an opposite side to the home position HP. In addition, a print area of the present embodiment is set to a position slightly closer to an inside (center side) from the positions of both a left end portion and a right end portion.

As illustrated in FIG. 7, the acceleration at the time of accelerating the carriage 4 to the constant speed and the acceleration at the time of deceleration of the carriage 4 from the constant speed are aligned so as to be constant. For this reason, the moving speed V at the constant speed area in which the carriage 4 moves at a constant speed is determined by the width of the acceleration area in which the carriage 4 is accelerated and the width of the deceleration area in which the carriage 4 is decelerated. For example, as illustrated in FIG. 7 as a dashed line, by determining an acceleration area a1' and a deceleration area a3', it is possible to set the moving speed at a constant speed area a2' positioned between those to a moving speed V1 of the carriage 4 which is allowed in a case where an amount of the pixel data SI is relatively small. Then, in a case where an amount of the pixel data SI is relatively large, the acceleration area is set to a1 narrower than the area a1', and the deceleration area is set to a3 narrower than the area a3'. By doing so, it is possible to set the moving speed of the carriage 4 at the constant speed area a2 positioned between those to a speed V2 which is allowed in this case. In this way, even in the present embodiment, the moving speed of the carriage 4 at the constant speed area a2 can be changed depending on an amount of the pixel data SI, and thus, it is possible to stabilize supplying of ink to the pressure chamber 25, and to suppress irregularity of an image or the like occurring due to an increase of the back pressure (negative pressure) of the pressure chamber 25. In addition, since the acceleration of the carriage 4 at the acceleration and deceleration areas a1 and a3 is not suppressed, it is possible to prevent the ejection of ink droplets at the acceleration and deceleration areas a1 and a3 from being excessively suppressed. As a result, it is possible to increase the ejection efficiency (printing efficiency) of the ink.

However, in the above-described embodiments, the moving speed of the carriage 4 is set at the constant speed area and the acceleration and deceleration areas, but the invention is not limited thereto. For example, the size of the back pressure may be calculated for each area corresponding to the pixel data SI (raster data), and the moving speed of the carriage 4 can be set in such a manner that irregularity of an image or the like due to an increase of the back pressure (negative pressure) of the pressure chamber 25 does not occur.

In addition, in the above-described embodiments, as the pressure generating unit, the piezoelectric element 17 of a so-called longitudinal vibration type is exemplified, but while not being limited to this, for example, it is also possible to employ a piezoelectric element of a so-called flexural vibration type. In this case, the exemplified driving signal has a waveform in which a direction of the change of a potential is inverted, that is, vertically inverted.

Furthermore, in the above-described embodiments, the ink jet type recording head which is mounted on an ink jet printer is exemplified, but it is also possible for the recording head to be applied to an apparatus which ejects liquid other than ink. For example, it is also possible to apply the invention to a color material ejecting head which is used for manufacturing a color filter of a liquid crystal display or the like, an electrode material ejecting head which is used for forming an electrode of an organic electro luminescence (EL) display, an FED (field emission display) or the like, a bio-organic material ejecting head which is used for manufacturing a bio-chip (biological and chemical element), or the like.

What is claimed is:

1. A liquid ejecting apparatus that includes a liquid ejecting head which includes a pressure generating unit for generating pressure variation of liquid stored in a pressure chamber communicating with a nozzle and which ejects the liquid towards a landing target from the nozzle according to driving of the pressure generating unit; a head moving unit which moves the liquid ejecting head in a scan direction; and a driving signal generating unit which generates a driving signal including an ejection pulse for ejecting the liquid from the nozzle, and that while moving the liquid ejecting head by the head moving unit, forms an image on the landing target based on ejection control data, comprising:

a control unit that in a case where an amount of the ejection control data corresponding to a predetermined area on the landing target is relatively large, performs control in such a manner that the moving speed of the liquid ejecting head at a constant speed section at which the liquid ejecting head moves at a constant speed is slower than that in a case where an amount of the ejection control data is relatively small, wherein in the case where the amount of the ejection control data is relatively large and in the case where the amount of the ejection control data is relatively small, ink is ejected from the ejecting head during the constant speed section, during an acceleration speed section that accelerates the moving speed to the constant speed section, and during a deceleration speed section that decelerates the moving speed from the constant speed section.

2. A liquid ejecting apparatus that includes a liquid ejecting head which includes a pressure generating unit for generating pressure variation of liquid stored in a pressure chamber communicating with a nozzle and which ejects the liquid towards a landing target from the nozzle according to driving of the pressure generating unit; a head moving unit which moves the liquid ejecting head in a scan direction; and a driving signal generating unit which generates a driving signal including an ejection pulse for ejecting the liquid from the nozzle, and that while moving the liquid ejecting head by the head moving unit, forms an image on the landing target based on ejection control data, comprising:

a control unit that in a case where an amount of the ejection control data corresponding to a predetermined area on the landing target is relatively large, performs control in such a manner that an acceleration and deceleration section at which the liquid ejecting head is accelerated or decelerated is shortened, and performs control in such a manner that the moving speed of the liquid ejecting head at a constant speed section at which the liquid ejecting head moves at a constant speed is slower than that in a case where an amount of the ejection control data is relatively small, wherein in the case where the amount of the ejection control data is relatively large and in the case where the amount of the ejection control data is relatively small, ink is ejected from the ejecting head during the constant speed section, during the acceleration speed section, and during the deceleration speed section.

3. A liquid ejecting apparatus that includes a liquid ejecting head which includes a pressure generating unit for generating pressure variation of liquid stored in a pressure chamber communicating with a nozzle and which ejects the liquid towards a landing target from the nozzle according to driving of the pressure generating unit; a head moving unit which moves the liquid ejecting head in a scan direction from a home position to an end position at an opposite end of the liquid ejecting apparatus from the home position in the scan direction; and a driving signal generating unit which generates a driving signal including an ejection pulse for ejecting the liquid from the nozzle, and that while moving the liquid ejecting head by the head moving unit, forms an image on the landing target based on ejection control data, comprising:

a control unit that in a case where an amount of the ejection control data corresponding to a predetermined area on the landing target is relatively large, performs control in such a manner that the number of timing pulses included at the predetermined area is larger than that in a case where an amount of the ejection control data is relatively small, wherein in the case where the amount of the ejection control data is relatively large and in the case where the amount of the ejection control data is relatively small, ink is ejected from the ejecting head toward the predetermined area as the ejecting head moves from the home position to the end position during a constant speed section of the ejecting head, during an acceleration speed section that accelerates a moving speed of the ejecting head to the constant speed section, and during a deceleration speed section that decelerates the moving speed from the constant speed section, the predetermined area being disposed inwardly from both the home position and the end position and from both terminal ends of the acceleration speed section and the deceleration speed section.

* * * * *